US007188422B2

(12) United States Patent
McCambridge et al.

(10) Patent No.: US 7,188,422 B2
(45) Date of Patent: Mar. 13, 2007

(54) ATTACHMENT FOR HAIR CLIPPERS

(75) Inventors: James McCambridge, Polo, IL (US); Scott Melton, Erie, IL (US)

(73) Assignee: Wahl Clipper Corporation, Sterling, IL (US)

( * ) Notice: Subject to any disclaimer, the term of this patent is extended or adjusted under 35 U.S.C. 154(b) by 433 days.

(21) Appl. No.: 09/955,690

(22) Filed: Sep. 19, 2001

(65) Prior Publication Data

US 2003/0051346 A1 Mar. 20, 2003

(51) Int. Cl.
*B26B 19/10* (2006.01)
*B26B 19/06* (2006.01)

(52) U.S. Cl. ..... 30/123; 30/34.1; 30/43.92; 30/122; 30/208

(58) Field of Classification Search ..... 30/124, 30/34.2, 123, 34.1, 122, 125, 34.05, 41.6, 30/43.9, 201, 200, 210, 216, 42, 233, 202, 30/23.5, 90, 208, 428, DIG. 2, 34.5; 69/25; D28/52, 42, 53, 60, 54; 29/425, 428
See application file for complete search history.

(56) References Cited

U.S. PATENT DOCUMENTS

| | | | | | |
|---|---|---|---|---|---|
| 1,546,912 | A * | 7/1925 | Beauchamp | ..... | 30/200 |
| 1,761,550 | A * | 6/1930 | Wahl | ..... | 30/201 |
| 2,292,364 | A * | 8/1942 | Cromonic | ..... | 30/201 |
| 2,300,143 | A * | 10/1942 | Berg | ..... | 30/34.1 |
| 2,707,328 | A * | 5/1955 | Witthofft | ..... | 30/202 |
| 3,262,200 | A * | 7/1966 | Suozzi | ..... | 30/201 |
| 3,287,805 | A * | 11/1966 | Du Charme | ..... | 30/202 |
| 3,874,079 | A * | 4/1975 | Waters | ..... | 30/34.1 |
| 4,031,617 | A * | 6/1977 | Tanaka et al. | ..... | 30/34.1 |
| 4,074,427 | A * | 2/1978 | Marchetti et al. | ..... | 30/34.1 |
| 4,724,614 | A | 2/1988 | Wahl et al. | ..... | 30/200 |
| 4,899,444 | A * | 2/1990 | Trichell et al. | ..... | 30/208 |
| 5,054,199 | A | 10/1991 | Ogawa et al. | ..... | 30/34.1 |
| 5,507,095 | A * | 4/1996 | Wetzel et al. | ..... | 30/34.1 |
| 5,579,581 | A * | 12/1996 | Melton | ..... | 30/223 |
| 5,701,673 | A * | 12/1997 | Ullmann et al. | ..... | 30/34.1 |
| 6,378,210 | B1 * | 4/2002 | Bickford | ..... | 30/43.92 |
| 6,502,312 | B2 * | 1/2003 | Beutel et al. | ..... | 30/216 |
| 6,505,403 | B1 * | 1/2003 | Andrews | ..... | 30/29.5 |
| 6,601,302 | B2 * | 8/2003 | Andrew | ..... | 30/34.1 |
| 6,684,509 | B1 * | 2/2004 | Best et al. | ..... | 30/43.92 |

* cited by examiner

*Primary Examiner*—Boyer D. Ashley
*Assistant Examiner*—Ghassem Alie
(74) *Attorney, Agent, or Firm*—Greer, Burns & Crain, Ltd.

(57) ABSTRACT

A hair trimmer or other attachment can be secured to a conventional hair clipper. The attachment has a stationary blade and a moving blade that cut hair when the moving blade reciprocates. The moving blade of the attachment is driven by a moving blade of the hair clipper, which also reciprocates. The attachment has a housing which secures the attachment to the stationary blade or other part of the hair clipper. A drive member engages the moving blade of the hair clipper when the attachment is secured to the hair clipper, and the drive member in turn drives the moving blade of the hair trimmer attachment to cut hair. The attachment can be easily detached so that the hair clipper blades can be used to cut hair in the usual manner.

14 Claims, 6 Drawing Sheets

ATTACHMENT FOR HAIR CLIPPERS

BACKGROUND OF THE INVENTION

This invention relates to hair clipper attachments, and more particularly, to hair clipper attachments that are driven by the reciprocating blade of the hair clipper.

Hair clippers are well known, as are beard and sideburn trimmers, ears/nose trimmers and the like. Hair clippers typically have wide, relatively thick blades which are good for clipping hair on the head, but are not adapted well for trimming sideburns, mustaches, beards, around the ears, the back of the neck, etc. Beard trimmers, on the other hand, have relatively narrow blades with less depth than hair clipper blades, to cut such hair. Ear and nose hair trimmers have even smaller blades.

Purchasing separate complete tools for hair, beards, etc. is expensive, and storage of the various tools is inconvenient. Thus, there is a need to reduce the number of tools needed for overall personal grooming. There is also a need to reduce the amount of storage space required for such tools.

Accordingly, one object of this invention is to provide new and improved attachments for hair clippers.

Another object is to provide new and improved hair trimmer attachments for hair clippers that reduce the number of separate, complete tools needed for overall personal grooming.

Still another object is to provide new and improved hair trimmer attachments for hair clippers that reduce the amount of storage space required for personal grooming tools.

SUMMARY OF THE INVENTION

In keeping with one aspect of this invention, a hair trimmer or other attachment can be secured over the blades of a conventional hair clipper. The attachment has a stationary blade and a moving blade that cut hair when the moving blade reciprocates. The moving blade of the attachment is driven by a moving blade of the hair clipper, which also reciprocates. The attachment has a housing that secures the attachment to the stationary blade or other part of the hair clipper. A drive member engages the moving blade of the hair clipper when the attachment is secured to the hair clipper, and the drive member in turn drives the moving blade of the hair trimmer attachment to cut hair. The attachment can be easily detached so that the hair clipper blades can be used to cut hair in the usual manner.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
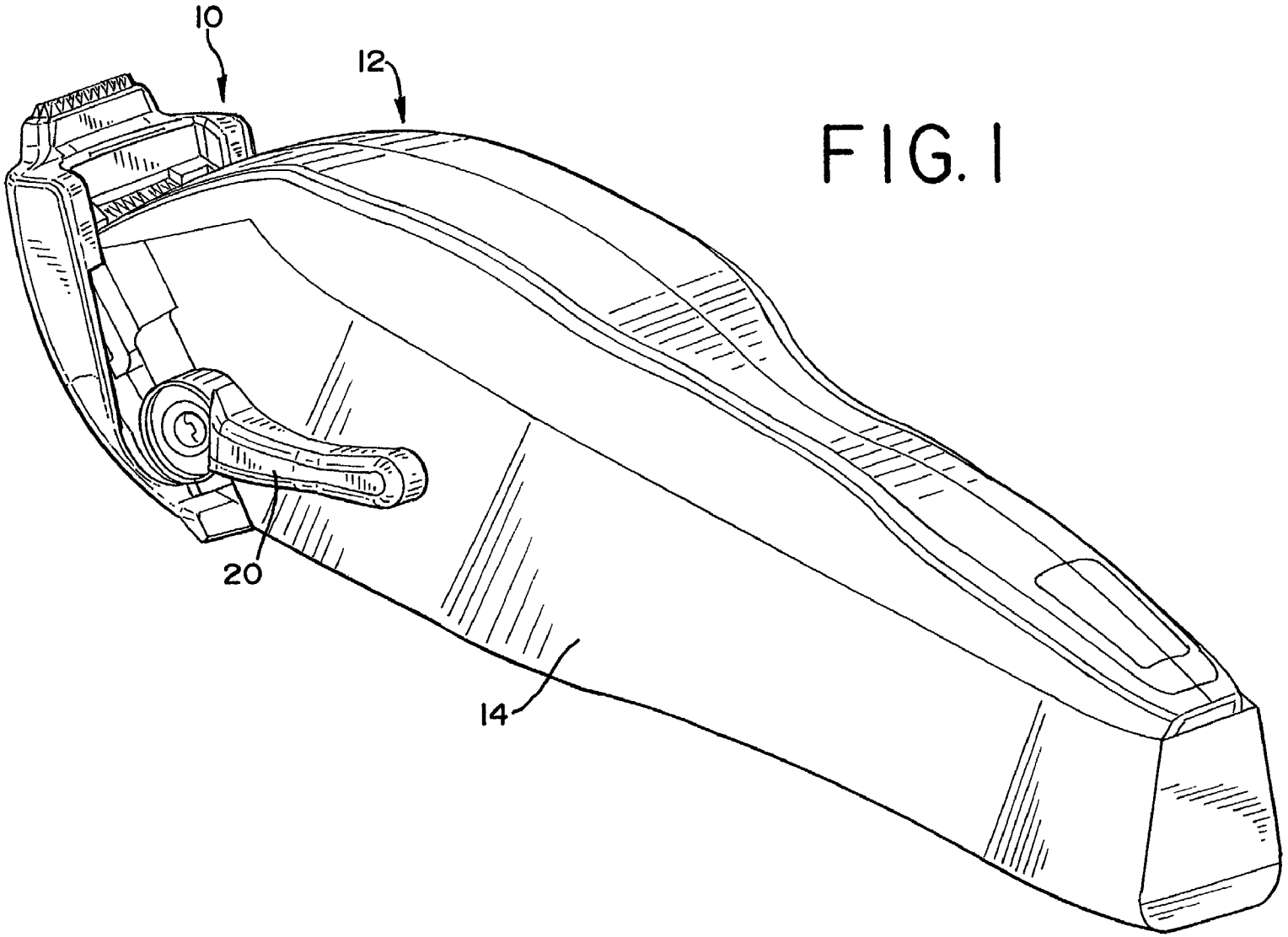
FIG. 1 is a perspective view of a hair trimmer attachment made in accordance with this invention, attached to a hair clipper.
Figure 2:
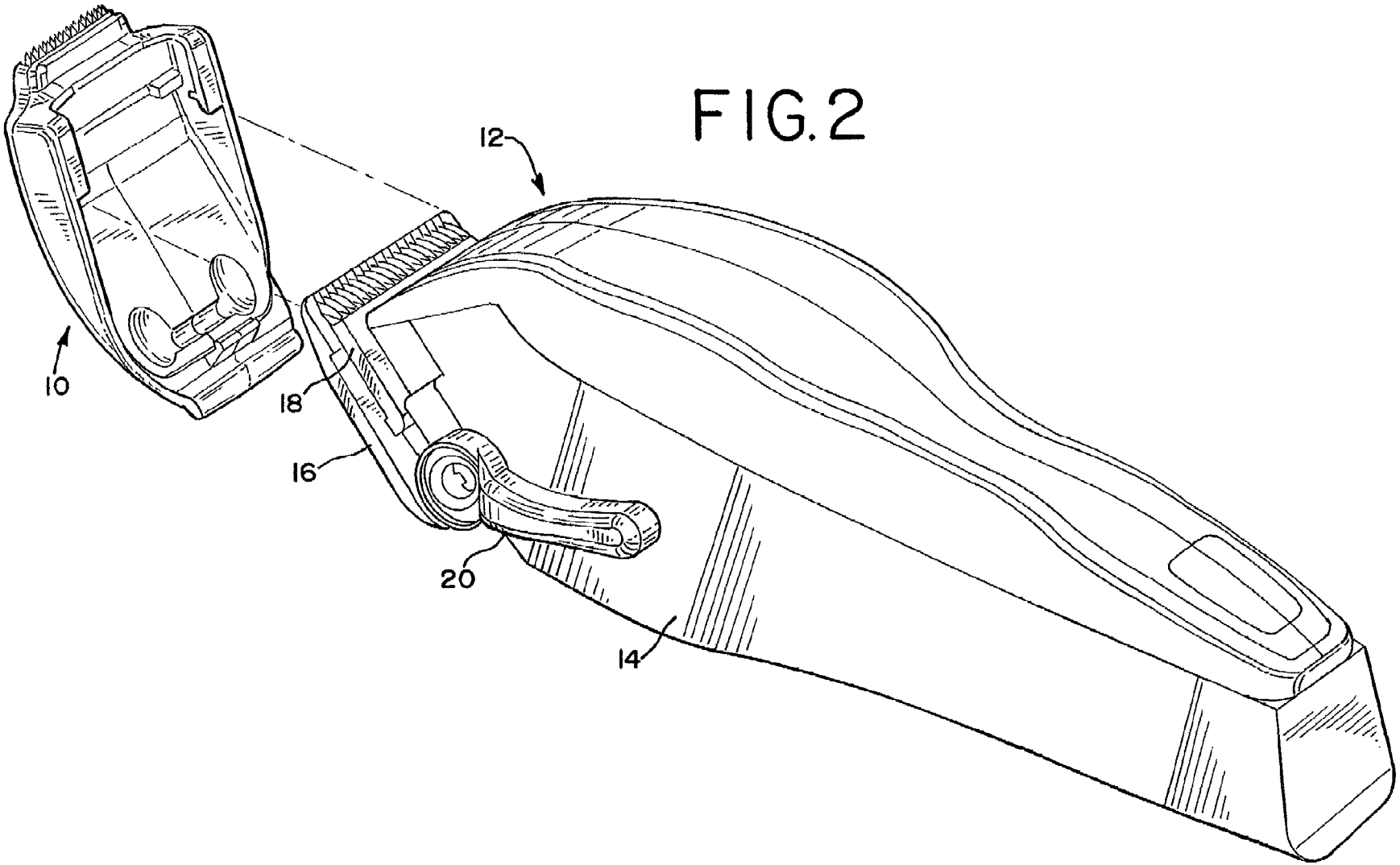
FIG. 2 is a perspective view of the attachment and hair clipper of FIG. 1, showing the attachment removed from the hair clipper.
Figure 3:
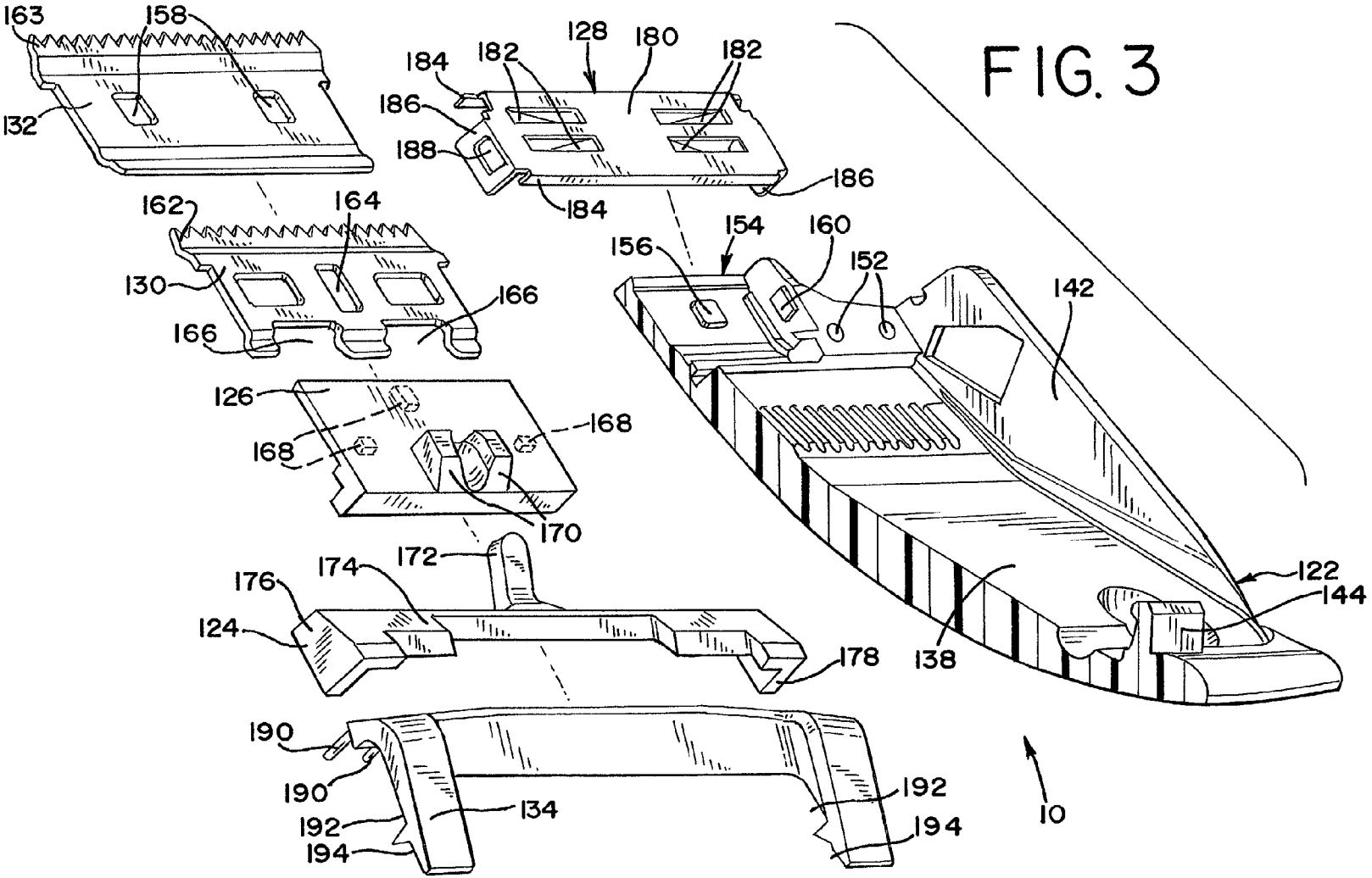
FIG. 3 is an exploded view of the attachment of FIG. 1, with the base shown in cross-section.
Figure 4:
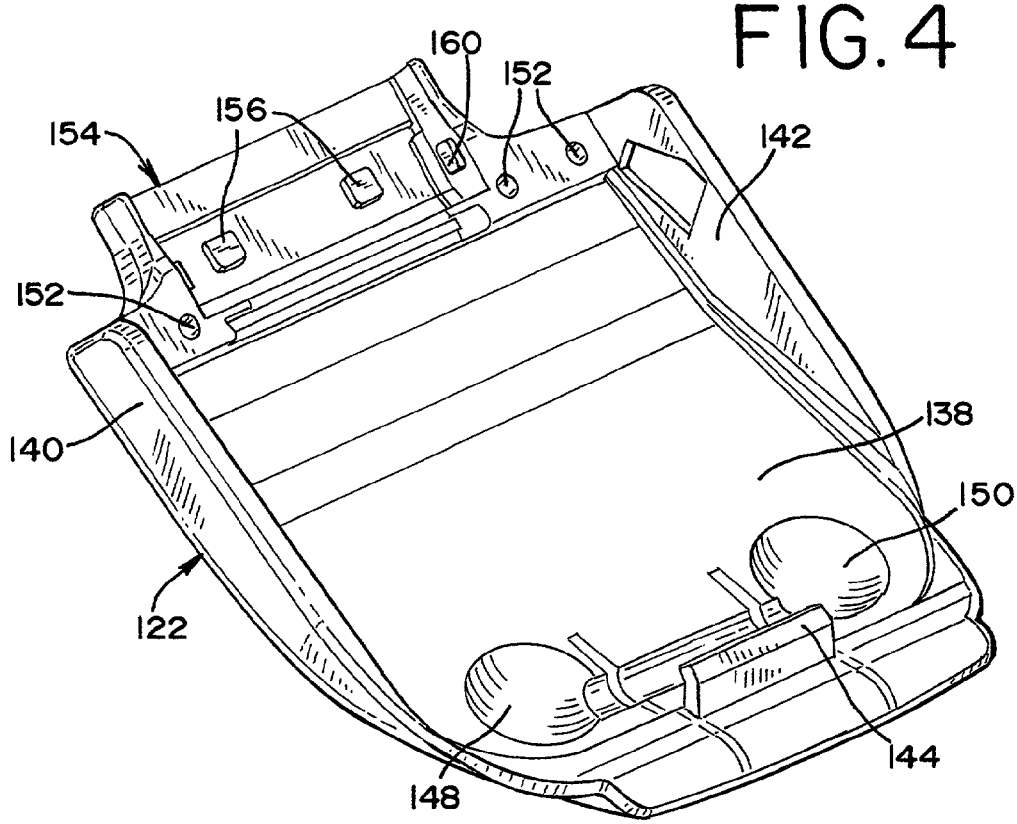
FIG. 4 is a perspective view of the base used for the attachment of FIG. 1.
Figure 5:
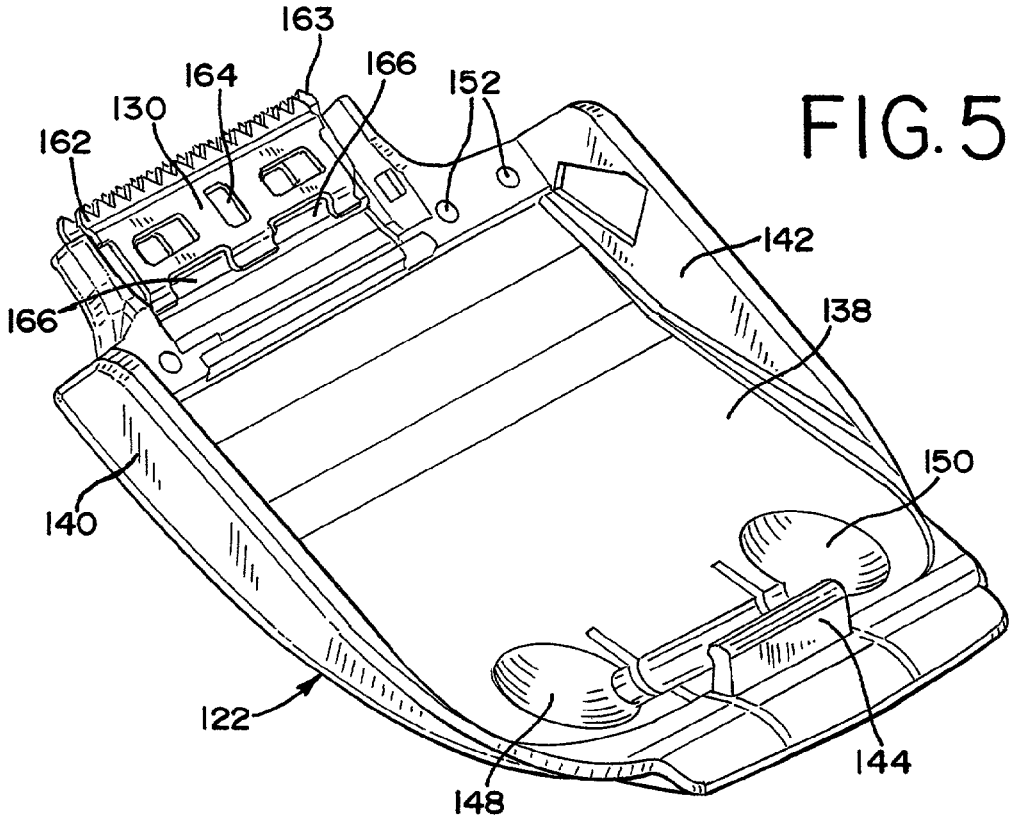
FIG. 5 is a perspective view of the attachment of FIG. 1, partially assembled.
Figure 6:
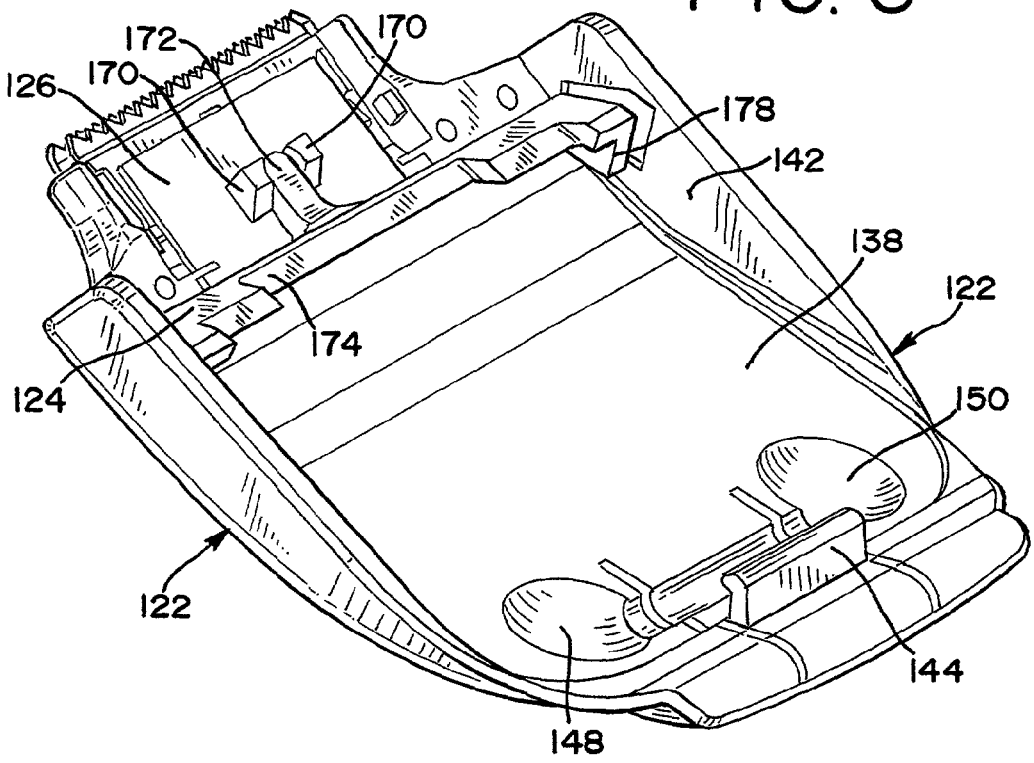
FIG. 6 is another perspective view of the attachment of FIG. 1, partially assembled.

FIG. 1 shows a trimmer attachment 10 secured to a hair clipper 12, and FIG. 2 shows the trimmer attachment 10 removed from the hair clipper 12. The hair clipper 12 includes a housing 14, a stationary blade 16 and a moving blade 18. The blades 16, 18 have complimentary blade teeth separated by spaces. In operation, the moving blade 18 reciprocates across the spaces to cut hair that enters the spaces. The stationary blade 16 is secured to the housing 14, typically with screws (not shown). A blade height adjustment 20 can be provided to adjust the height of the moving blade 18 with respect to the stationary blade 16. The hair clipper 12 can be used to cut hair in the usual manner when the attachment 10 is removed. When the attachment is secured over the blades, as in FIG. 1, cutting blades in the attachment can be used to cut hair, as will be seen.

The attachment 10 is shown in greater detail in FIGS. 3 through 7. The attachment 10 (FIG. 3) includes abase 122, a drive arm 124, ablade guide 126, a blade spring 128, a reciprocating blade 130 and a stationary blade 132. A holder 134 is also provided. The blades 130, 132 typically are not as wide as the blades 16, 18, to more easily cut hair in confined spaces, such as around the ears. Moreover, the overlap or blade set-back of the moving and stationary teeth of the trimmer attachment is less than the set-back of the hair clipper moving and stationary blade teeth to cut hair closer, in places such as behind the neck.

The base 122 (FIG. 4) includes a bottom 138 and sides 140, 142. A snap 144 is provided for securement to the stationary blade 16 of the hair clipper 10. The snap 144 is flexible enough to permit easy removal of the attachment from the hair clipper. Indentations 148, 150 can be provided, if desired, to accommodate the screw heads typically found in hair clippers.

The base 122 may also have a plurality of openings 152 for securement of the holder 134, as will be seen. In addition, the base 122 has a recessed region 154 sized to fit around part of the periphery of the stationary blade 132, and protrusions 156 that pass through openings 158 in the stationary blade 132. The protrusions 156 position the stationary blade 132, and can be used to sonically weld the stationary blade 132 to the base, if desired. The base 122 also has side protrusions 160 for securement of the blade spring 128, as will be seen.

The reciprocating blade 130 rests against the stationary blade 132 (FIG. 5) so that complimentary teeth 162, 163 on the blades 130, 132 cut hair that enters spaces between the teeth. The moving blade 130 also includes at least one opening 164 and recesses 166. The blade guide 126 includes a plurality of protrusions 168 which fit in the opening 164 and the recesses 166. The blade guide 126 can be secured to the moving blade 130 by sonic welding or any other suitable way, if desired.

The blade guide 126 also has a pair of spaced outwardly extending walls 170 on the side opposite the protrusions. The walls 170 are sized and arranged to accept a ball 172 of the drive arm 124. Among other things, the ball 172 absorbs manufacturing tolerances and maintains engagement even if the hair clipper blades move in a slight arc, or are slightly angled.

The drive arm 124 includes a lateral bar 174 and two side walls 176, 178. The side walls 176, 178 surround the sides of the moving blade of the hair clipper when the attachment is secured to the clipper. In this manner, the moving blade 18 of the hair clipper moves the drive arm 124, which in turn moves the blade guide 126 and moving blade 130 to trim hair. The side walls 176, 178 extend far enough from the lateral bar 174 to capture the moving blade 18.

Figure 7:
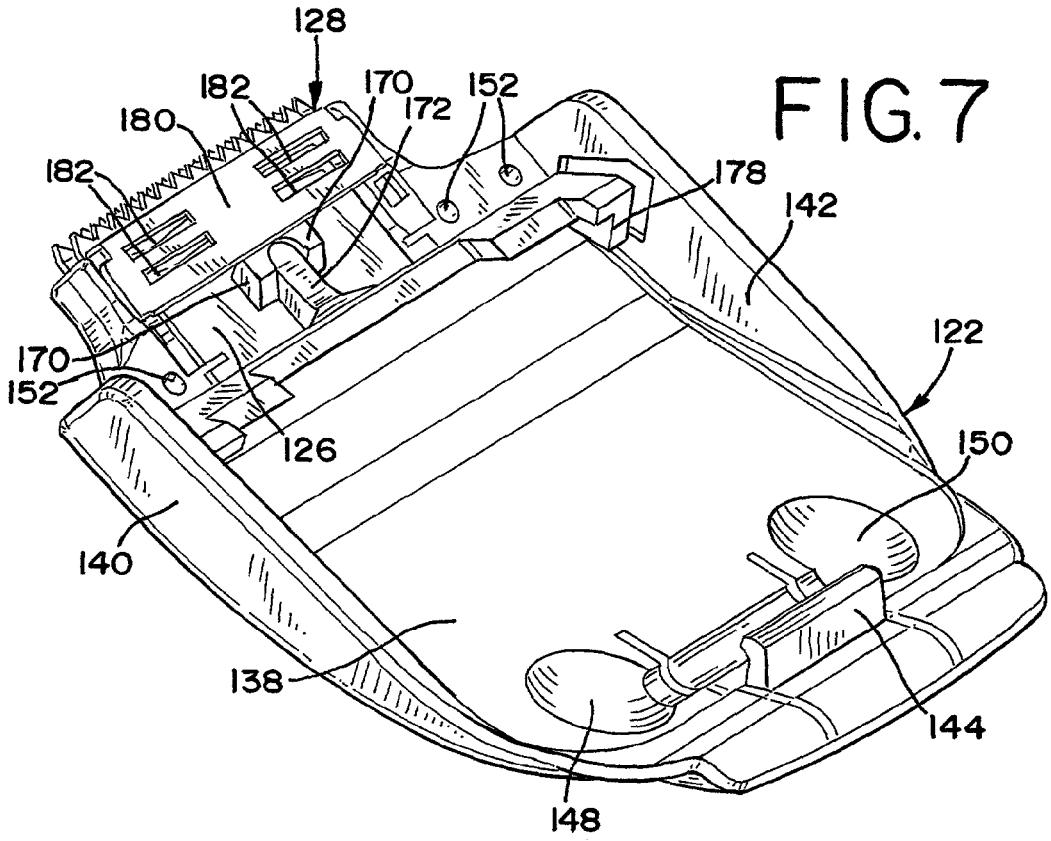
FIG. 7 is another perspective view of the attachment of FIG. 1, partially assembled.
Figure 8:
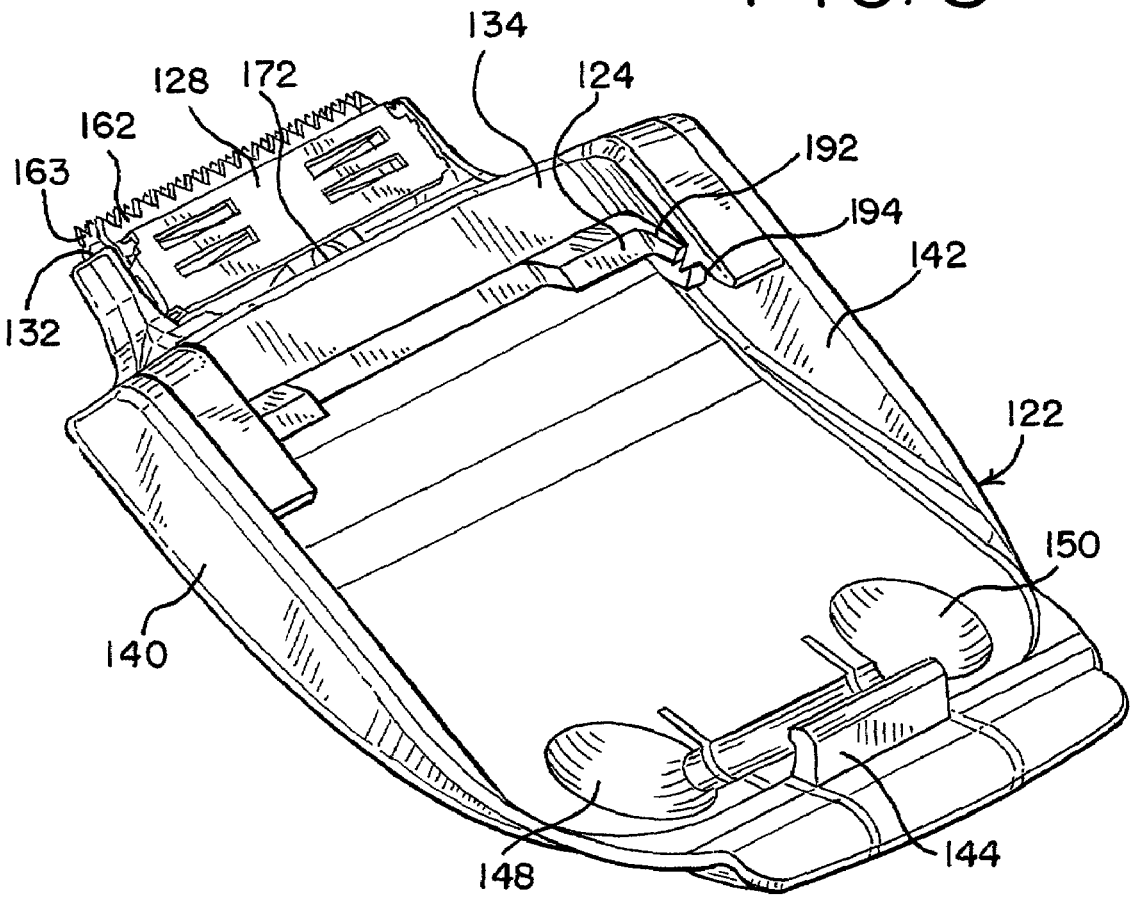
FIG. 8 is another perspective view of the attachment of FIG. 1, partially assembled.

The blade spring 128 secures the blade guide/moving blade assembly over the stationary blade 132, while allowing the moving blade to reciprocate in operation, as seen in FIG. 7. The blade spring 128 can be any suitable device, including the spring shown in FIG. 3. The spring 128 includes a bar 180, a plurality of spring members 182, and sides 184. The sides 184 provide stiffness. In addition, ends 186 are bent over and provided with openings 188. The protrusions 160 in the bottom 138 fit in the openings 188 to secure the spring 128 to the bottom 138.

The drive arm 124 is secured by the holder 134, which in turn may be secured to the base 122 by pins 190 that fit in the openings 152 of the bottom 138. The pins 190 can also be secured by sonic welding or the like. The drive arm 124 is slideably secured in recesses 192. The holder 134 also secures the attachment 10 to the hair clipper 12. Recesses 194 are provided for this purpose. The holder 134 extends at least partially over the top (or cutting teeth) of the stationary blades, and its front and back sides. The sides 140, 142 of the base 122 set the attachment 10 properly with respect to the width of the stationary blade 16.

The many advantages of this invention are now apparent. Hair can be clipped with the hair clipper, and beards, mustaches, sideburns, around the ears, the back of the neck, etc., can be trimmed with the hair trimmer attachment, without buying separate complete tools. The trimmer attachment can be made to be used with most conventional hair clippers. The amount of storage space required is also reduced. Also, the attachment surrounds the blades of the hair clipper, which are typically larger than the trimmer attachment blades, to avoid inadvertently cutting hair with the hair clippers.

While the principles of the invention have been described above in connection with specific apparatus and applications, it is to be understood that this description is made only by way of example and not as a limitation on the scope of the invention. While a hair trimmer attachment has been described, it is contemplated that other devices such as massagers, ear and nose hair trimmers and the like, could be attached to the hair clipper and driven in a similar manner.

What is claimed is:

1. A trimmer attachment for a hair clipper, the hair clipper having a stationary blade and a reciprocating blade, the attachment comprising:

means for securing the attachment to the hair clipper;

a movable trimmer blade that reciprocates in response to reciprocation of the reciprocating blade of the hair clipper, a stationary trimmer blade that complements the movable trimmer blade, the movable trimmer blade reciprocating across the stationary trimmer blade to cut hair, and a base, the stationary trimmer blade being secured in the base, wherein the base covers the stationary blade of the hair clipper to avoid unintentional cutting by the hair clipper when the trimmer attachment is secured to the hair clipper.

2. The trimmer attachment of claim 1, comprising:

a drive arm at least partially surrounding the reciprocating blade of the hair clipper, and a blade guide operatively connected to the drive arm and also secured to the movable trimmer blade.

3. The trimmer attachment of claim 2, comprising:

a spring secured to the base over the blade guide, and a holder secured to the base over the drive arm, to hold the drive arm in place.

4. The trimmer attachment of claim 3 wherein the holder also secures the attachment to the hair clipper.

5. The trimmer attachment of claim 1 wherein hair clipper blades have a first width and the movable trimmer blade has a second width narrower than the first width.

6. The trimmer attachment of claim 3 wherein the base has two sides that secure the attachment laterally.

7. A trimmer attachment for a hair clipper, the hair clipper having a stationary blade and a reciprocating blade, the attachment comprising:

means for removably securing the attachment to the hair clipper;

a movable trimmer blade that reciprocates in response to reciprocation of the reciprocating blade of the hair clipper.

a stationary trimmer blade that complements the movable trimmer blade, the movable trimmer blade reciprocating across the stationary trimmer blade to cut hair, and a base, the stationary trimmer blade being secured to the base, wherein the base covers the stationary blade of the hair clipper to avoid unintentional cutting by the hair clipper when the trimmer attachment is secured to the hair clipper.

8. The trimmer attachment of claim 7, comprising:

a drive arm at least partially surrounding the reciprocating blade of the hair clipper, and a blade guide operatively connected to the drive arm and also secured to the movable trimmer blade.

9. The trimmer attachment of claim 8, comprising:

a spring secured to the base over the blade guide, and a holder secured to the base over the drive arm, to hold the drive arm in place.

10. The trimmer attachment of claim 9 wherein the holder also secures the attachment to the hair clipper.

11. A trimmer attachment for a hair clipper, the hair clipper having a stationary blade and a reciprocating blade, the attachment comprising:

means for securing the attachment to the hair clipper;

a movable trimmer blade that is driven, in a reciprocating manner, by reciprocation of the reciprocating blade of the hair clipper.

a stationary trimmer blade that complements the movable trimmer blade, the movable trimmer blade reciprocating across the stationary trimmer blade to cut hair, and a base, the stationary trimmer blade being secured in the base, wherein the base covers the stationary blade of the hair clipper to avoid unintentional cutting by the hair clipper when the trimmer attachment is secured to the hair clipper.

12. The trimmer attachment of claim 11, comprising:

a drive arm at least partially surrounding the reciprocating blade of the hair clipper, and a blade guide operatively connected to the drive arm and also secured to the movable trimmer blade.

13. The trimmer attachment of claim 12, comprising:

a spring secured to the base over the blade guide, and a holder secured to the base over the drive arm, to hold the drive arm in place.

14. The trimmer attachment of claim 13 wherein the holder also secures the attachment to the hair clipper.

* * * * *

UNITED STATES PATENT AND TRADEMARK OFFICE

CERTIFICATE OF CORRECTION

PATENT NO. : 7,188,422 B2
APPLICATION NO. : 09/955690
DATED : March 13, 2007
INVENTOR(S) : McCambridge et al.

It is certified that error appears in the above-identified patent and that said Letters Patent is hereby corrected as shown below:

Col. 2, line 23, delete “abase” and insert --a base--.

Col. 2, line 24, delete “ablade” and insert --a blade--.

In the Claims:

Col. 4, line 44, delete “clipper.” and insert --clipper,--.

Signed and Sealed this

Third Day of July, 2007

JON W. DUDAS
*Director of the United States Patent and Trademark Office*